8-107

8/20/85 OR 4,536,182

SR

United States Patent [19]

Tatin

[11] Patent Number: 4,536,182

[45] Date of Patent: Aug. 20, 1985

[54] BATH AND METHOD FOR THE SIMULTANEOUS DESIZING AND BLEACHING OF FABRICS

[75] Inventor: Gerárd Tatin, Creil, France

[73] Assignee: Atochem, Paris, France

[21] Appl. No.: 587,214

[22] Filed: Mar. 7, 1984

[30] Foreign Application Priority Data

Mar. 22, 1983 [FR] France ..... 83 04646

[51] Int. Cl.[3] ..... D06L 1/06; D06L 3/02; C11D 7/54

[52] U.S. Cl. ..... 8/107; 8/101; 8/102; 8/138; 8/139

[58] Field of Search ..... 8/107, 138, 139

[56] References Cited

U.S. PATENT DOCUMENTS

| | | | |
|---|---|---|---|
| 4,100,095 | 7/1978 | Hutchins et al. | 252/99 |
| 4,170,453 | 10/1979 | Kitko | 8/111 |
| 4,195,974 | 4/1980 | Kothe et al. | 8/138 |
| 4,391,745 | 7/1983 | Denkler et al. | 8/138 |
| 4,457,760 | 7/1984 | Cholley | 8/111 |

FOREIGN PATENT DOCUMENTS

| | | |
|---|---|---|
| 55664 | 7/1982 | European Pat. Off. . |
| 51-103088 | 9/1976 | Japan . |
| 1442419 | 7/1976 | United Kingdom . |

*Primary Examiner*—A. Lionel Clingman

*Attorney, Agent, or Firm*—Sigalos & Levine

[57] ABSTRACT

A bath for the simultaneous desizing and bleaching of fabrics comprising hydrogen peroxide, a sequestering agent, an amylase, a surfactant, and a buffer consisting essentially of sodium tetraborate decahydrate. Also, the method for the simultaneous desizing and bleaching a fabric comprising saturating a fabric with the above destarching and bleaching bath, maintaining the saturated fabric for a time and at a temperature sufficient to desize and bleach to the desired degree, and washing the fabric.

9 Claims, No Drawings

BATH AND METHOD FOR THE SIMULTANEOUS DESIZING AND BLEACHING OF FABRICS

BACKGROUND OF THE INVENTION

The present invention relates to a bath and method for the desizing and bleaching of fabrics in a single operation in a bath based on hydrogen peroxide.

Such a bath and method are the subject of French patent application No. 80 27866, equivalent to U.S. Pat. No. 4,457,760.

French patent application No. 80 27866 discloses using a bath comprising hydrogen peroxide, sodium hydroxide, a sequestering agent, an amylase, a surfactant, and, optionally, a stabilizing agent such as sodium silicate.

The commercial implementation of this procedure has encountered certain difficulties. On the one hand, the results obtained depend on the pH fixed at the start. In fact, at a very alkaline pH the bleaching is excellent, but the desizing generally is inadequate. Conversely, at a low alkaline pH the desizing is good but the bleaching is inadequate.

On the other hand, the level of results is closely linked to the nature of the fabric subjected to the desizing/bleaching treatment, with the enzymatic degradation of the starches used as sizing generating acidic products which cause the pH to fluctuate during the course of the reaction.

Depending on the quantity and the nature of the starches used for the sizing of the fabric, the pH of the desizing/bleaching bath is more or less modified during the course of the treatment, leading to important differences between the level of bleaching results and the level of desizing results.

These observations have led the applicant to search for a buffer capable of fixing the pH of the desizing/-bleaching bath in order to have at one's disposal a simultaneous desizing/bleaching procedure, making it possible to obtain both optimum desizing and bleaching, while at the same time not adversely affecting the degree of polymerization of the particular fiber.

SUMMARY OF THE INVENTION

The present invention overcomes the problems discussed above and furnishes an improved bath and method for the simultaneous desizing/bleaching of fabrics.

Briefly stated, the bath comprises hydrogen peroxide, a sequestering agent, an amylase, a surfactant, and sodium tetraborate decahydrate. Optionally, sodium silicate can be added as a stabilizing agent.

The invention also comprises the method of simultaneously desizing and bleaching fabrics comprising saturating a sized fabric with the above-noted bath, maintaining said saturated fabric for a time and at a temperature sufficient to desize and bleach to the degree desired, and then washing said fabric to remove the unreacted bath and byproducts.

DETAILED DESCRIPTION

During the course of investigation numerous buffers were tested and it was surprisingly found that only with sodium tetraborate decahydrate were a good desizing and a good bleaching obtained at the same time.

A desizing/bleaching bath utilizable according to the instant invention comprises an aqueous bath containing:

| | |
|---|---|
| 35% $H_2O_2$ | 40–60 ml/l |
| Sodium silicate (stabilizing agent) | about 20 g/l |
| Sequestering agent | 2–6 g/l |
| Amylase | 8–12 g/l |
| Surfactant | 1–2 ml/l, |

and a buffer consisting of sodium tetraborate decahydrate in a quantity determined so as to fix the pH of the bath at 9.8. This is generally about 10 g of sodium tetraborate decahydrate for each liter of a bath as set forth above.

The adoption of the simultaneous desizing/bleaching method of the present invention makes it possible to achieve important savings in water, steam, labor, and capital investment and leads to desizing/bleaching results which are superior to those obtained without buffer or by utilizing another buffer which is capable of fixing the pH of the bath at an equivalent value.

Moreover, the use of sodium tetraborate decahydrate as the buffer avoids working in a strongly alkaline medium and thus protects the fabric being treated against the formation of "cracks" during the course of deposition thereof in folds.

The sizes used as starchy materials; amylaceous in nature, against which the amylase enzymes are effective.

The invention also comprises the method of desizing/bleaching that is described in greater detail in the examples that follows.

In the examples the desizing/bleaching tests described were carried out according to the following method:

(1) Saturating the sized and natural-colored (unbleached) fabric in the desizing/bleaching bath; squeezing the fabric in order to leave in the fabric only the quantity of bath necessary for the reaction; this quantity was fixed at 100% of the weight of the dry fabric;

(2) Steaming the fabric in order to raise the temperature thereof to the desired reaction temperature of about 90°–95° C.;

(3) Maintaining the temperature at about 90°–95° C. for approximately one hour while the fabric is either in folds or in a roll; and (4) Washing in aqueous baths, first, at 90°–95° C., then at 60° C., and finally in a cold bath of water to remove whatever remains of the bath and byproducts.

The basic aqueous desizing/bleaching bath used in the examples that follow contained for each liter:

| | |
|---|---|
| Ethylene Diamine Tetraacetic Acid (TRILON C by B.A.S.F.) | 2 g/l |
| Sodium silicate | 20 g/l |
| 35% Hydrogen peroxide | 40 ml/l |
| High temperature Amylase (Enzylase C by DIAMALT) | 10 g/l |
| Non-ionic wetting agent (UKANIL 1036 by PCUK) | 1.5 ml/l |

The following examples are set forth for purposes of illustration of the invention only and not by way of limitation.

EXAMPLES 1 TO 5

Examples 1 to 5 were carried out with a 100% cotton cloth of 160 g/m² containing as sizing 9.20% of starch compounds (amylaceous materials) and having a ZEISS ELREPHO reflectance of 56° and a polymerization index of 1940.

The following buffers were tested by being added to the bath noted above (the quantities indicated are expressed in g for 1/l of bath):

| | | |
|---|---|---|
| Example 1 | Sodium formate<br>pH obtained: 10.4 | 15 g/l |
| Example 2 | Sodium bicarbonate<br>Potassium carbonate<br>pH obtained: 9.5 | 22 g/l<br>8.4 g/l |
| Example 3 | Sodium metaborate<br>pH obtained: 9.8 | 14 g/l |
| Example 4 | Glycine<br>pH obtained: 10.4 | 20 g/l |
| Example 5 | Sodium tetraborate decahydrate<br>pH obtained: 9.8 | 10 g/l |

Examples 1 to 4 are comparative examples and Example 5 illustrates a procedure according to the present invention. The results obtained are set forth in Table I below.

TABLE I

| Example | White (in °ELREPHO) | Residual starch in %/weight of fabric | Hydrophilic affinity (absorbency) s |
|---|---|---|---|
| 1 | 81.5 | 0.60 | 0.4 |
| 2 | 78.2 | 1.95 | 0.2 |
| 3 | 83.5 | 0.61 | 1.0 |
| 4 | 78.9 | 0.34 | 0.4 |
| 5 | 82.5 | 0.22 | 0.1 |
| | DP* = 1620 | | |

*Degree of polymerization

Only the use of sodium metaborate (Example 3) yields a degree of white superior to the one obtained with sodium tetraborate decahydrate (Example 5 according to the invention), but the ratio of residual starch obtained in Example 3 is too high (the ratio of residual starch of Example 3 amounts to 0.61, while it is only 0.22 in Example 5).

Moreover, the hydrophilic affinity of Example 5 is 10 times lower than that of Example 3. Also, the degree of polymerization (DP=1620) obtained in Example 5 according to the invention shows that the fiber is not degraded during the course of the desizing/bleaching operation.

EXAMPLES 6 TO 10

Examples 6 to 10 were carried out with a 100% cotton cretonne of 190 g/m² containing as sizing 11.57% of starch compounds (amylaceous materials) and having a ZEISS ELROPHO reflectance of 55° and a polymerization index of 2700.

The buffers tested were identical to the ones tested in Examples 1–5. The buffer of Example 6 is identical to the one used in Example 1; Example 7 corresponds to Example 2; Example 8 corresponds to Example 3; Example 9 corresponds to Example 4, and Example 10 corresponds to Example 5.

Examples 6 to 9 are comparative examples, while Example 10 illustrates a method according to the present invention.

The results are set forth in Table II below.

TABLE II

| Example | White (in °ELREPHO) | Residual starch in %/weight of fabric | Hydrophilic affinity (absorbency) s |
|---|---|---|---|
| 6 | 76.2 | 0.85 | 1 |
| 7 | 73.3 | 2.92 | 1 |
| 8 | 77.9 | 0.79 | 1.6 |
| 9 | 75.6 | 0.42 | 1 |
| 10 | 76.8 | 0.21 | 1.2 |
| | DP = 1930 | | |

EXAMPLES 11 TO 15

Examples 11 to 15 were carried out with a 100% cotton poplin of 140 g/m² containing as sizing 7.6% of starch compounds (amylaceous materials) and having a ZEISS ELREPHO reflectance of 52.2°, and a polymerization index of 2700.

The buffers tested are as follows: The buffer of Example 11 is identical to the one used in Example 1; Example 12 corresponds to Example 2; Example 13 corresponds to Example 3; Example 14 corresponds to Example 4; and Example 15 corresponds to Example 5.

Examples 11 to 14 are comparative examples, and Example 15 illustrates a desizing/bleaching procedure according to the present invention.

The results are set forth in Table III below.

TABLE III

| Example | White (in °ELREPHO) | Residual starch in %/weight of fabric | Hydrophilic affinity (absorbency) s |
|---|---|---|---|
| 11 | 80.9 | 1.82 | 1.4 |
| 12 | 75.9 | 7.7 | 0.9 |
| 13 | 83 | 3.31 | 1 |
| 14 | 79.6 | 2.5 | 1.2 |
| 15 | 82.6 | 0.79 | 1 |
| | DP = 1830 | | |

The above examples show that only the use of sodium tetraborate decahydrate according to the present invention makes it possible to simultaneously obtain a good bleaching and a satisfactory desizing (starch removal).

EXAMPLES 16 TO 18

The bath described above, to which 10 g/l of sodium tetraborate decahydrate were added, was used in order to carry out the simultaneous desizing/bleaching of three different 67/33 polyester/cotton fabrics whose ratios of starchy compounds (amylaceous materials), respectively, were:

| | |
|---|---|
| Example 16 | 12.2% |
| Example 17 | 9.5% |
| Example 18 | 8.9% |

The results are set forth in Table IV below.

TABLE IV

| Example | White (in °ELREPHO) | Residual starch in %/weight of fabric | Hydrophilic affinity (absorbency) s |
|---|---|---|---|
| 16 | 85.6 | 0 | 0.4 |
| 17 | 81.4 | 0 | 0.8 |
| 18 | 85.1 | 0 | 0.8 |

The fabrics contained no starch and the white content obtained was remarkable.

It will be understood that the reaction time can be varied dependent upon the degree of bleaching (whiteness) and starch removal desired.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A bath for the simultaneous desizing and bleaching of fabrics comprising hydrogen peroxide, a sequestering agent, an amylase, a surfactant, and a buffer consisting essentially of sodium tetraborate decahydrate.

2. The bath of claim 1, including addition of a stabilizing agent.

3. The bath of claim 2, wherein the constituents thereof are present, for each liter of the aqueous bath, in the following amounts:

| | |
|---|---|
| $H_2O_2$ (35%) | 40–60 ml |
| Sequestering Agent | 2–6 g |
| Amylase | 8–12 g |
| Surfactant | 1–2 ml |
| Stabilizing Agent | 20 g, and |
| Sodium tetraborate decahydrate in an amount sufficient to give the bath a pH of about 9.8. | |

4. The bath of claim 3, wherein the sequestering agent is ethylene diamine tetraacetic acid, the surfactant is a nonionic, and the stabilizing agent is sodium silicate.

5. A method for the simultaneous desizing and bleaching of a fabric comprising:

(a) saturating said fabric with a desizing and bleaching bath comprising hydrogen peroxide, a sequestering agent, an amylase, a surfactant, and a buffer consisting essentially of sodium tetraborate decahydrate;

(b) maintaining said saturated fabric for a time and at a temperature sufficient to desize and bleach the fabric to the degree desired; and (c) washing said fabric.

6. The method of claim 5, wherein the bath also includes a stabilizing agent.

7. The method of claim 6, wherein the bath constituents are present, for each liter of the aqueous bath, in the following amounts:

| | |
|---|---|
| $H_2O_2$ (35%) | 40–60 ml |
| Sequestering Agent | 2–6 g |
| Amylase | 8–12 g |
| Surfactant | 1–2 ml |
| Stabilizing Agent | 20 g, and |
| Sodium tetraborate decahydrate in an amount sufficient to give the bath a pH of about 9.8. | |

8. The method of claim 7, wherein the sequestering agent is ethylene diamine tetraacetic acid, the surfactant is nonionic, and the stabilizing agent is sodium silicate.

9. The method of claim 8, wherein the temperature is 90° to 95° C. and the treatment time is approximately one hour.

* * * * *